United States Patent [19]

Hünninghaus

[11] 4,063,316

[45] Dec. 20, 1977

[54] TOILET SEAT CLEANING SYSTEM

[76] Inventor: Kurt Hünninghaus, Gewerbestr. 51, 7803 Gundelfingen, Germany

[21] Appl. No.: 635,154

[22] Filed: Nov. 25, 1975

[30] Foreign Application Priority Data

Nov. 27, 1974 Germany ..... 2456020

[51] Int. Cl.[2] ..... A47K 13/00; A47K 13/24; A47K 13/30; A47K 17/00

[52] U.S. Cl. ..... 4/233; 4/1

[58] Field of Search ..... 4/1, 233, 229, 230, 4/222, 242

[56] References Cited

U.S. PATENT DOCUMENTS

| | | | |
|---|---|---|---|
| 1,492,825 | 5/1924 | Abbott | 4/233 |
| 3,599,246 | 8/1971 | Bramati | 4/233 |
| 3,815,158 | 6/1974 | Schnyder et al. | 4/233 |
| 3,837,018 | 9/1974 | Haberle | 4/233 |

FOREIGN PATENT DOCUMENTS

| | | | |
|---|---|---|---|
| 2,132,688 | 1/1972 | Germany | 4/233 |
| 2,263,474 | 8/1972 | Germany | 4/233 |

*Primary Examiner*—Henry K. Artis
*Attorney, Agent, or Firm*—Michael J. Striker

[57] ABSTRACT

A cleaning system for toilet seats containing fluidic conduits and exit slits therefrom; using water, air, drying, deodorizing and disinfecting agents, a blower, a water wheel drive therefor, and a seat-actuated automatic control valve.

35 Claims, 4 Drawing Figures

TOILET SEAT CLEANING SYSTEM

BACKGROUND OF THE INVENTION

This invention relates to toilet seats and, in particular, cleaning systems therefor. More particularly it pertains to fluidic cleaning and to toilet seats and associated apparatus therefor.

PRIOR ART

Toilet seats have been used for at least several hundred years but have only been popular and used in very large numbers within the last hundred years. Deodorizing agents have been used in conjunction with toilets for very many years. The use of disinfectants is much more recent and was only initiated after an understanding of the concept of transfer of infection. Liquid disenfectants are common. Gaseous disinfectants have been used with some precaution and trepidation. Spraying of liquid disinfectants is now well known.

There are known products and systems for dissolving deodorizers and disinfectants in water closets, water lines, and toilet bowls.

Some mechanical and electrical systems for deodorizing or disenfecting toilet seats have been known, including the use of lighting systems such as in the ultraviolet region. Except for the last preceding sentence, other approaches mentioned for sanitizing toilet seats involve manual labor and are therefore irregular, unreliable and expensive in the long run.

SUMMARY OF THE INVENTION

It is therefore an object of this invention to overcome the limitations and disadvantages in the devices in the prior art and those currently available in the market.

One of the objects of the invention is to provide a toilet seat cleaning system embodying improved advanced principles of design and construction.

An important object of the invention is to provide a toilet seat cleaning system which is comprised of durable parts and components which can be economically manufactured and readily assembled.

A significant object of the invention is to provide a toilet seat cleaning system, so designed and contructed that it can be readily applied to almost any typical water closet toilet now in use.

Another object of the invention is to provide a fluidic system for cleaning, deodorizing and disinfecting toilet seats. A further object of the invention is to provide a system that also cleans, deodorizes and disinfects the toilet bowl.

Yet another object of the invention is to provide a system for deodorizing the entire toilet area.

A still further object of the invention is to provide a self powered system requiring no external energy connections.

A toilet seat cleaning system, according to the principles of this invention, comprises a hollow fluidic conduit equipped seat with exit slits therefrom, a water source, chemical mixing chambers, a blower, an automatic water control valve, and blower driving means.

Further objects and advantages of this invention will appear more clearly from the following description of non-limiting illustrative embodiments and the accompanying drawings in which like numerals designate like parts throughout the several views.

BRIEF DESCRIPTION OF THE DRAWING

Briefly summarized, a preferred embodiment of the invention is described in conjunction with an illustrative disclosure thereof in the accompanying drawings, in which.

DESCRIPTION OF THE PREFERRED EMBODIMENTS

Figure 1:
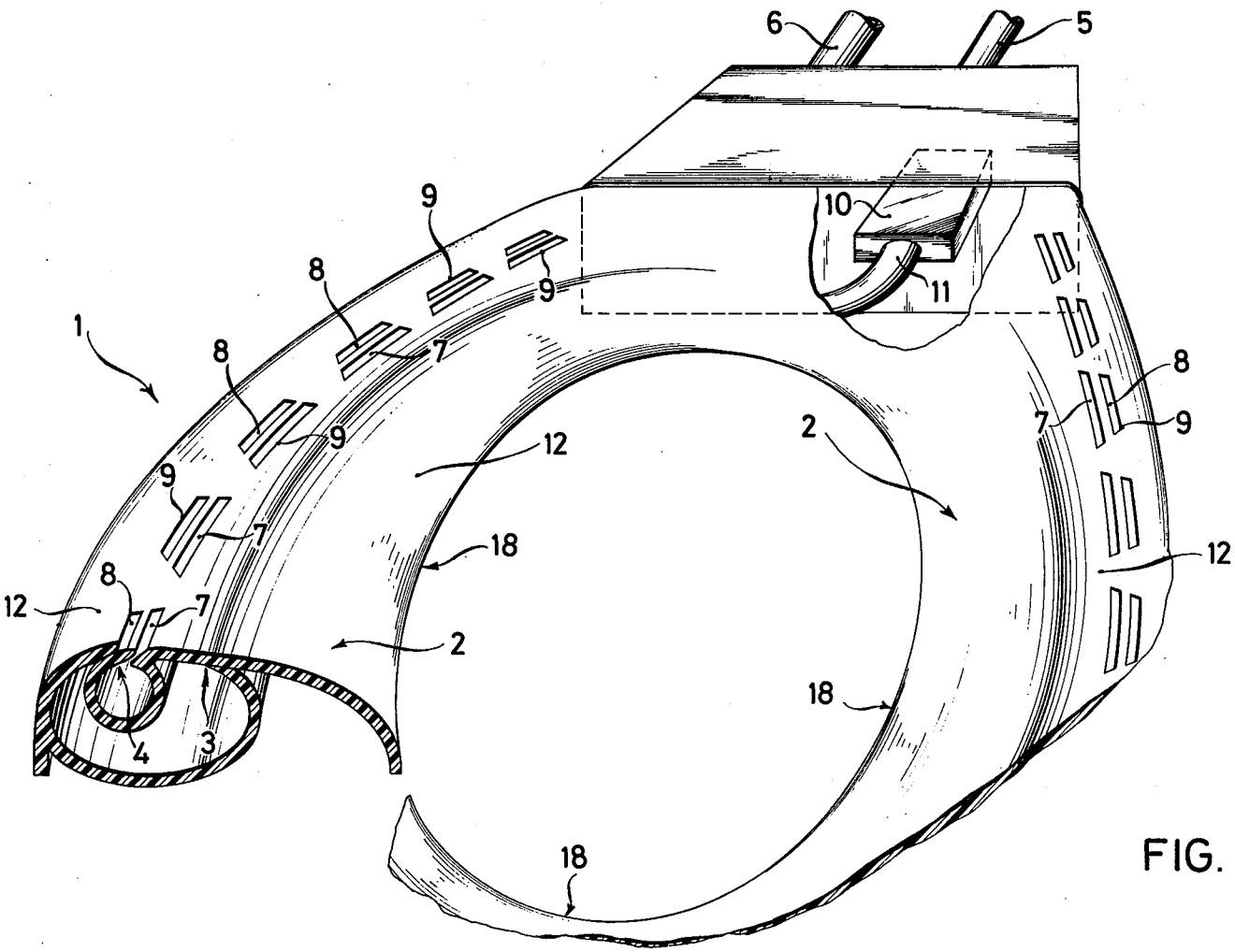
FIG. 1 is a pictorial representation of the toilet seat showing fluidic conduits and controls, and applying the principles of the invention.
Figure 2:
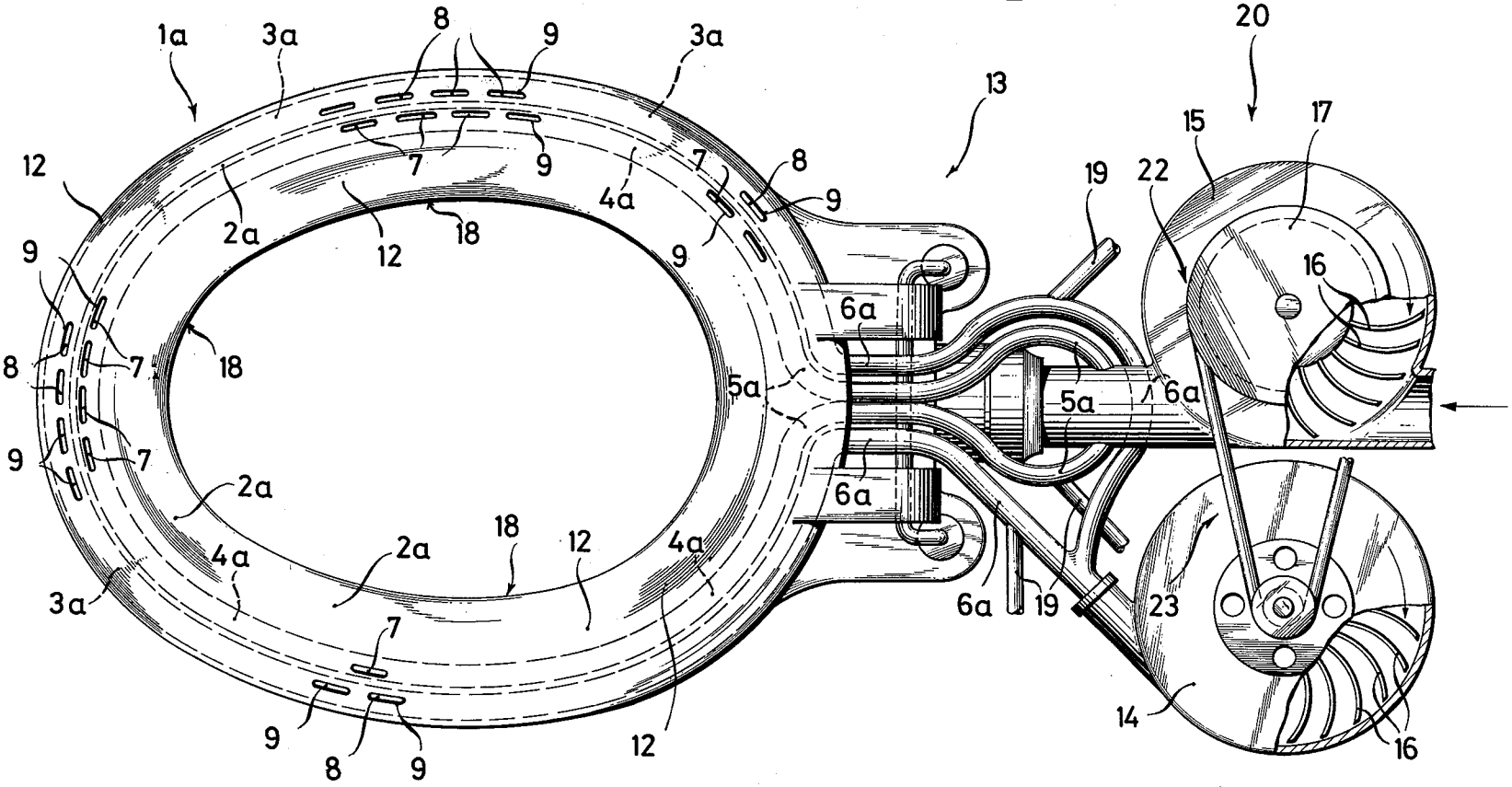
FIG. 2 is a plan view of the toilet seat showing fluidic conduits, a blower and a water wheel drive.
Figures 3, 4:
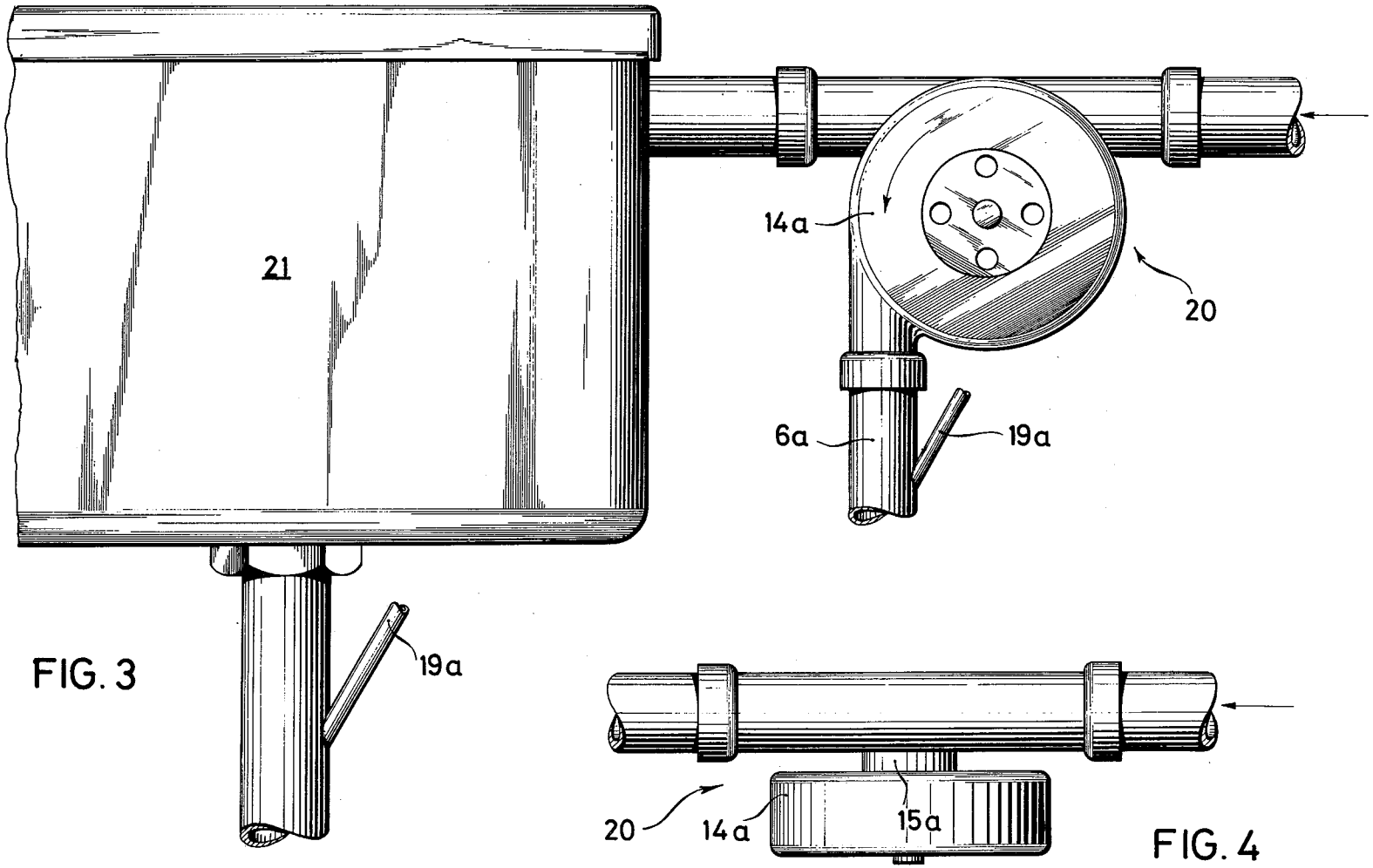
FIG. 3 is an elevation view of a fluidic container such as a water closet, associated conduits and a water wheel.
FIG. 4 is a view orthogonal to FIG. 3.

In the drawings a sanitary toilet installation embodying features of the invention is illustrated employing a toilet seat 2 provided with conduits 3, 4 having exits 7, 8, 9 through which fluids, either liquid or gaseous, may be discharged.

The sanitary purpose of cleaning and subsequently drying a toilet seat may be accomplished in various ways, including the use of a fluidic agent which, when flowed over the seat 2, cleans it and may perform other desirable functions, including drying, disinfecting and deodorizing.

The two most available fluidic agents are, of course, water and air, and these are the preferred media for accomplishing the several functions associated with cleaning. Either water or air may, when combined with suitable chemical agents, perform most of the above-mentioned functions, but the use of both a liquid and a gas will generally provide more satisfactory results.

Many known chemical agents suitable for mixing with a liquid or a gas are available to assist in the accomplishment of drying, deodorizing or disinfecting. It is likely that more such chemical agents will be developed in the future.

The intent here is to provide an essentially automatic method, and suitable equipment therefor, for sanitizing toilet seats so as to reduce the spread of infections of various types and to improve the well-being, including emotional, of the users of toilet seats—the general public.

The automatic method may require initial capital expenditure, but is economical in the long run by the virtual elimination of the requirement for manual labor.

The method consists in the use of a liquid such as water, which may contain chemical agents, to flush the surface of the seat 2 to remove particles therefrom; succeeded by a second flushing with a drying agent, which may be a gas such as air and may also include chemical agents, to dry the surface **2*a*** of the seat and present it in an acceptable manner for its next use.

As earlier mentioned, the toilet seat 2 of a conventional appearance is modified by the provision of conduits 3, 4 for fluids and exits 7, 8, 9 from the conduits 3, 4 which are preferably located in the surface **2*a* of the seat, particularly the upper surface. The conduits 3, 4 may be attached to the seat 2, may be part of the seat, or may be hollow cavities within the seat and must be connected to external conduits 5*a*, 6*a* for delivery of suitable fluids. A single conduit may be used for a single fluid or cyclic succession of fluids; or multiple conduits may be employed, one for each fluid. The conduits may be adjacent or one within the other or even concentric. The conduits in the seat must be connected to exits 7, 8, 9 located at the surface 2***a* of the seat 2 which may be round holes, long slots, shaped exits to direct the fluid flow, or the like—all of which are known orifices in the field of fluid flow.

The conduits may be of equal size, or the conduit for gaseous flow may well be bigger than that for liquid flow.

Sanitary toilets connected to water systems are quite common and most are connected to a suitable reservoir 21 generally referred to as a water closet.

To provide adequate, rapid gas flow across the seat, an air compressor such as a blower 14 is required. The output of such a blower 14 is connected via suitable conduits 6*a* to a conduit 3 in the seat.

Energy for powering the blower 14 may be obtained from any of many suitable sources. The two most convenient sources in the usual toilet installation are the water flow and electrical energy. Electrical energy may be used to power an electrical actuator such as a rotary electric motor which may be used to drive the blower.

The water flow may be used to power a water wheel 15 which may be used to drive the blower 14, thereby eliminating the capital expense of an electric installation. To make the arrangement reasonably compact and convenient, the blower 14 and the water wheel 15 should be close to the seat 2. The water closet 31 and generally connected to the toilet bowl 30 by a pipe and the water wheel may be conveniently connected to the pipe 31, being careful not to have the water wheel blades 16 excessively interfere with the water flow, by protruding too far into the stream.

The blower 14 may be mounted tandem to the water wheel 15, employing a common axis or may be connected to the water wheel 15 by a suitable mechanical drive, such as a belt 23 with its attendant pulleys 22.

In practice, the flushing action used in the toilet bowl 30 would coincide with the water flushing action at the seat 2 and with the operating period of the water wheel 15. Since the drying action should succeed the washing, the blower 14 should continue to operate after the water flow has stopped and the water wheel 15 has decelerated and even stopped. This may be readily accomplished by using a rotatable flywheel 22 connected to the water wheel by an overrunning clutch 17 which permits the flywheel 22 to continue rotating after the water wheel 15 has stopped. The flywheel 22 may be physically located at either the water wheel axis 33 or the blower axis 34, and may be suitably combined with one of the pulleys 22 if a belt drive is used. In most cases, it will be desirable to operate the blower 14 at higher rotational speeds than the water wheel 15.

In the fluid systems, suitable containers and mixing chambers may be provided for the addition of chemical agents which may be employed in solid, liquid, or gaseous form. Branched conduits 19, 27, 28, 29 connected to the main conduits 52, 62 will bring these additives into the main fluid flow.

All liquid using sanitary toilet systems must have a valve for controlling fluid flow, particularly for starting and stopping it. An automatic valve 10 is here provided which is actuated by the seat 2 position or the seat dynamics. In general, the seat is used in the horizontal position and may be stored in an inclined or even vertical position. At each end of the seat travel about its pivot axis 35, the seat 2 decelerates to a stop, or is slammed. The slamming action may be used to actuate the valve 10. The valve 10 is here shown schematically located to interrupt the fluid flow in the conduits 11.

The toilet seat is of more or less conventional shape having a large central opening or hole 18, and a curved exterior contour 24 and is mounted to pivot 35 in the rear at a mechanical connection to a base which is usually the toilet bowl 30. The exits 7, 8, 9 from the conduits 3, 4 in the toilet seat 2 may be organized in groups or series of openings, generally arranged parallel to the edges 18, 24 of the seat 2, and possibly in the outer areas of the seat.

From the foregoing, the construction and operation of the device will be readily understood and further explanation is believed superfluous.

The invention includes all novelty residing in the description and drawings. It is obvious to those skilled in the art that various minor changes can be made without departing from the concept of this invention and all such as fall within the reasonable scope of the appended claims are included.

I claim:

1. In a toilet having a toilet seat, a fluidic system for cleaning the toilet seat comprising conveying means for conveying fluids and for passing the fluids over the toilet seat, said conveying means comprising at least one conduit for conveying fluids, said conduit being provided with a plurality of outlets connecting said conduit with the exterior of the toilet seat and positioned so as to direct fluid flow over the toilet seat; and propelling means connected to said conduit and operative for driving fluids into said conduit and out said outlets and over the toilet seat to clean the latter.

2. A system as in claim 1, further comprising valve means connected to said conduit and connected to the toilet seat, operative for interrupting or not interrupting fluid flow to the outlets of said conduit by respectively closing and opening said valve means in dependence upon the position of said toilet seat.

3. A system as in claim 2, wherein one conduit is within the other.

4. A system as in claim 1, further comprising valve means connected to said conduit and connected to the toilet seat, operative for interrupting or not interrupting fluid flow to the outlets of said conduit by respectively closing and opening said valve means in dependence upon movement of the toilet seat.

5. A system as in claim 1 wherein the conduit is within the seat.

6. A system as in claim 2, wherein the outlets are arranged in a pattern substantially parallel to the outer edge of the seat.

7. A system as in claim 1, wherein the outlets are arranged in groups.

8. A system as in claim 1, wherein the outlets are at the upper surface of the seat.

9. A system as in claim 6, wherein the outlets are arranged in a row.

10. A system as in claim 9, wherein the outlets are arranged in more than one row.

11. A system as in claim 10, wherein each row of outlets is connected to a particular conduit.

12. A system as in claim 1; further comprising at least one branch pipe connected to the conduit for introducing additives to a fluid.

13. A system as in claim 2, wherein the valve means is actuated when the seat is in an approximately horizontal position.

14. A system as in claim 4, wherein the valve means is rendered operative by slamming the seat.

15. A system as in claim 2, wherein the valve is automatically opened in dependence upon the seat assuming one of two end positions.

16. A system as in claim 4, wherein the valve is automatically closed in dependence upon the seat being moved to one of two end positions.

17. A system as in claim 5; further comprising a toilet bowl upon which the seat rests.

18. A system as in claim 1; further comprising a toilet bowl on which said seat is mounted.

19. In a toilet having a toilet body including a seat having an upper face and being pivotally connected to the toilet body, an automatic cleaning system for cleaning the toilet seat comprising cleaning means associated with the toilet seat for cleaning and drying the upper face of the seat, said cleaning means comprising at least one supply conduit means for carrying cleaning and drying fluids and having a plurality of outlets opening upon the upper face of the toilet seat and propelling means for driving the respective fluids through the conduit means and onto the upper face of the toilet seat.

20. A combination as defined in claim 19, the toilet body including a bowl and a seat having an upper face and a lower face and being pivotally connected to the toilet body and selectively movable to two positions, a lower position in which the lower face of the toilet seat is located upon the toilet bowl and an upper position in which the lower face of the toilet seat is located away from the toilet bowl wherein said propelling means is operative when actuated for driving the respective fluids through said conduit means and onto the upper face of the toilet and wherein said propelling means further comprises actuating means operative for actuating said propelling means when the toilet seat is located in the lower position.

21. A combination as defined in claim 19, wherein said conduit means is located within the toilet seat.

22. A combination as defined in claim 19, said cleaning means further comprising containers for storing the respective fluids, said containers being exteriorly located with respect to the seat and being connected to said conduit means.

23. A combination as defined in claim 19, said conduit means having a plurality of outlets opening upon the upper face of the toilet seat and being arranged in rows parallel to the outer edge of the toilet seat.

24. A system as in claim 1, wherein said conveying means comprises two conduits, each having outlets connecting the respective conduits with the exterior of the toilet seat and positioned so as to direct fluid flow over the toilet seat, said propelling means comprising means operative for driving a different fluid through each of the respective conduits.

25. A system as in claim 17, further comprising at least one main fluid pipe connected both to the bowl and to said conduit for conveying fluid both into the bowl and into said conduit.

26. A system as in claim 25 further comprising a water wheel connected to said main fluid pipe for driving fluid into said conduit.

27. A system as in claim 5, said propelling means further comprising blowing means connected to said conduit operative for blowing a gaseous fluid through said conduit and outlet.

28. A system as in claim 27, said blowing means comprising a blower.

29. A system as in claim 26, wherein the water wheel is provided with blades on an impeller, which blades enter only slightly into the main fluid pipe.

30. A system as in claim 25, wherein the main fluid pipe is branched.

31. A system as in claim 27, said blowing means further comprising an electric driving means for the blower.

32. A system as in claim 28, said propelling means further comprising a water wheel for driving the blower; the water wheel being connected by driving means to the blower.

33. A system as in claim 32; said propelling means further comprising a belt drive as part of the driving means.

34. A system as in claim 33; said propelling means further comprising a flywheel as part of the driving means.

35. A system as in claim 33, further comprising means permitting operation of said blower after said water wheel ceases to drive the blower, said means comprising an overriding clutch.

* * * * *